United States Patent [19]

Hamano et al.

[11] Patent Number: 4,765,872

[45] Date of Patent: Aug. 23, 1988

[54] METHOD FOR TREATING A PLATING SOLUTION

[75] Inventors: Toshikatsu Hamano, Machida; Yukio Matsumura, Ichihara, both of Japan

[73] Assignee: Asahi Glass Company, Ltd., Tokyo, Japan

[21] Appl. No.: 113,906

[22] Filed: Oct. 29, 1987

[30] Foreign Application Priority Data

Oct. 31, 1986 [JP] Japan ..... 61-258546
Oct. 31, 1986 [JP] Japan ..... 61-258548

[51] Int. Cl.[4] ..... C25D 21/16
[52] U.S. Cl. ..... 204/130
[58] Field of Search ..... 204/140, 130, 48

[56] References Cited

U.S. PATENT DOCUMENTS 3,573,181 3/1971 Cochran ..... 204/130

*Primary Examiner*—T. M. Tufariello
*Attorney, Agent, or Firm*—Oblon, Fisher, Spivak, McClelland & Maier

[57] ABSTRACT

A method for treating a plating solution in an electrolytic cell having a cathode compartment and an anode compartment partitioned by an ion-exchange membrane, which comprises supplying a plating solution containing not more than 10 g/liter of $Fe^{3+}$ ions to the cathode compartment and an electrically conductive solution to the anode compartment, and electrolytically reducing the $Fe^{3+}$ ions in the plating solution to $Fe^{2+}$ ions, wherein an electrode having a hydrogen overvoltage of not higher than 350 mV, preferably made of a carbon material, is used as a cathode.

7 Claims, No Drawings

METHOD FOR TREATING A PLATING SOLUTION

The present invention relates to a method for treating a plating solution. More particularly, it relates to a treating method to maintain unnecessary $Fe^{3+}$ ions contained in an iron-type electroplating solution at a concentration not higher than a certain level.

A plating solution, particularly for electroplating of an iron-type material such as iron or an iron-zinc alloy, is useful, for example, for the rust prevention of a metal steel plate or for the undercoating treatment for an overcoating material. In such electroplating, it is common to employ an aqueous solution containing $Fe^{2+}$ ions as the plating solution. However, during the electroplating, water is electrolyzed and $Fe^{2+}$ are oxidized to $Fe^{3+}$ by the oxygen generated by the electrolysis of water or by the oxygen in air, which leads to a serious problem for plating.

Heretofore, as a means to convert such $Fe^{3+}$ back to $Fe^{2+}$, it has been proposed to electrolytically reducing them in a cell partitioned by an ion exchange membrane (Japanese Examined Patent Publication No. 36600/1986).

However, in such a proposal, a material having a high hydrogen overvoltage and thus having a high reduction efficiency is used as the cathode, whereby iron is likely to partially precipitate on the cathode, which in turn is likely to damage the ion exchange membrane.

The present inventors have conducted various studies with an aim to find a means free from such a drawback. As a result, it has been found that when the electrolytic reduction is conducted in a cell partitioned by an ion exchange membrane by using a cathode having a hydrogen overvoltage not higher than a certain specific level, $Fe^{3+}$ are preferentially reduced to $Fe^{2+}$ ions even in the presence of both $Fe^{3+}$ ions and $Fe^{2+}$ ions and even when the concentration of $Fe^{3+}$ ions is relatively low which give more excellent plating performance, and the precipitation of iron from $Fe^{2+}$ ions can effectively be prevented.

Thus, the present invention provides a method for treating a plating solution in an electrolytic cell having a cathode compartment and an anode compartment partitioned by an ion-exchange membrane, which comprises supplying a plating solution containing not more than 10 g/liter of $Fe^{3+}$ ions to the cathode compartment and an electrically conductive solution to the anode compartment, and electrolytically reducing the $Fe^{3+}$ ions in the plating solution to $Fe^{2+}$ ions, wherein an electrode having a hydrogen overvoltage of not higher than 350 mV is used as a cathode.

Now, the present invention will be described in detail with reference to the preferred embodiments.

In the present invention, the cathode is required to have a hydrogen overvoltage of not higher than 350 mV. If the hydrogen overvoltage exceeds this range, reduction of $Fe^{2+}$ to Fe takes place, and iron precipitates on the electrode, whereby the ion exchange membrane will be damaged.

It is particularly preferred to employ a cathode having a hydrogen overvoltage of not higher than 200 mV, more preferably not higher than 100 mV, so that the reduction of $Fe^{3+}$ to $Fe^{2+}$ takes place preferentially and no substantial generation of hydrogen gas occurs, whereby a reduction of the current efficiency can be suppressed.

Such a cathode may be made of a Raney nickel, a platinum-group metal powder coated on a valve metal such as titanium, or an iron alloy such as stainless steel treated by etching. The cathode usually has a specific surface area of at least 0.1 $m^2/g$, preferably from 10 to 1,000 $m^2/g$, as measured by a nitrogen gas adsorption method.

Further, it has been found possible to preferentially reduce $Fe^{3+}$ ions even in the presence of both $Fe^{3+}$ ions and $Fe^{2+}$ ions and to prevent the precipitation of iron from $Fe^{2+}$ ions by using a cathode made of a carbon material such as a carbon fiber woven fabric, a carbon fiber non-woven fabric or a carbon powder, which has high durability to maintain a cell voltage at the same level even in a long operation and is inexpensive and which is capable of minimizing the hydrogen overvoltage.

The carbon fiber type cathode used in the present invention may have the following constructions. The carbon fiber woven fabric may be, for example, the one prepared by using a yarn made preferably of from 1,000 to 12,000 filaments with a diameter of from 1 to 10 $\mu m$ and having a thickness of preferably from 0.1 to 5 mm and a density of preferably from 0.1 to 2.0 g/cc. The carbon fiber non-woven fabric may be, for example, the one having a density of preferably from 0.02 to 0.5 g/cc. When the carbon powder is used, it may be fixed on a synthetic resin film or on an iron plate by means of an electrically conductive adhesive or by means of an electrically conductive yarn to form an electrode, or the carbon powder is kneaded with a resin and then formed into a film useful as an electrode. The carbon powder preferably has a particle size within a range of from 0.01 to 5 $\mu m$. The cathode made of such carbon material preferably has a specific surface area of at least 50 $m^2/g$, more preferably from 500 to 10,000 $m^2/g$, as measured by a nitrogen gas adsorption method.

If the physical properties of the cathode are outside the above ranges, it is likely that the surface area of carbon will be inadequate for the reduction reaction, whereby the overvoltage increases, and electrolytic precipitation of iron due to the reduction of $Fe^{2+}$ will take place, and in some cases, the flow of the electrolyte or the current distribution tends to be non-uniform, whereby local electrolytic precipitation will take place.

The carbon fiber woven fabric or non-woven fabric is electrically conductive by itself. However, in some cases, it is preferred to use a highly conductive material such as a stainless steel plate as a core material or a supporting material to provide the electrically conductivity and self-sustaining property.

The cathode made of carbon material preferably has a weight of from 200 to 400 $g/m^2$ in the case of the carbon fiber woven fabric, from 15 to 50 $g/m^2$ in the case of the carbon fiber non-woven fabric and from 150 to 1,500 $g/m^2$ in the case of the carbon powder fixed on a substrate surface, whereby the reduction of $Fe^{3+}$ to $Fe^{2+}$ can be conducted preferentially and the decrease in the crrrent efficiency due to the reduction of hydrogen ions can be suppressed. It may sound illogical that the generation of hydrogen ions can be suppressed as the hydrogen overvoltage is lower. As a result of the detailed research, it has been found that the lower the hydrogen overvoltage, the higher the specific surface area, whereby the reduction of $Fe^{3+}$ to $Fe^{2+}$ preferentially proceeds, and no generation of hydrogen which requires a higher level of energy takes place.

The concentration of $Fe^{3+}$ ions contained in the plating solution to be subjected to the electrolytic reduction is usually not higher than 10 g/liter, preferably not higher than 7 g/liter, most preferably not higher than 3 g/liter, whereby the properties of the carbon electrode will be exhibited characteristically.

The anions in the plating solution are preferably acid radicals such as sulfuric acid ions or halogen ions. The content of such acid radicals is preferably adjusted to bring the pH of the plating solution to a level of from 0.5 to 3.0, preferably from 1 to 2.5.

The electrically conductive solution to be supplied to the anode compartment may be any electrolytic solution so long as it is capable of providing an electrical conductivity without adversely affecting the plating solution. However, it is preferred to use an acid or an acid salt having the same acid radical as contained in the plating solution. For instance, there may be employed sulfuric acid or hydrochloric acid, or an alkali metal salt or an ammonium salt of such an acid. The concentration of the electrically conductive solution is preferably from 1 to 10% by weight. However, it is particularly preferred that the concentration of the electrically conductive solution is at the same level as the acid radicals in the plating solution.

The anode to be used in the present invention may be made of a material which has corrosion resistance against the electrically conductive solution in the anode compartment and having a low oxygen overvoltage, preferably, platinum group metal such as iridium or a platinum-iridium alloy.

The distance between the electrodes and the ion exchange membrane in the electrolytic cell is preferably from 0.5 to 10 mm, more preferably from 1 to 3 mm. The electrolytes are supplied preferably at a rate of from 5 to 100 cm/sec., preferably from 15 to 60 cm/sec. The current density in the electrolytic cell is preferably from 0.5 to 20 $A/dm^2$ in view of the reduction efficiency, the reduction rate and the required electric power.

The ion exchange membrane to be used in the present invention may be any membrane which may not necessarily be called an ion exchange membrane so long as it has an ion selectivity, and unless it has a large electric resistance or unless it increases the cell voltage. The ion exchange membrane may be a cation exchange membrane or an anion exchange membrane. However, when the plating solution contains acid groups, it is advantageous to use a cation exchange membrane. The ion exchange membrane preferably has heat resistance, acid resistance and oxidation resistance, and may be a hydrocarbon polymer type or a fluorine-containing polymer type which may be of strongly acidic type or weakly acidic type, or strongly basic type or weakly basic type. The ion exchange capacity of the membrane is preferably from 0.5 to 4.0 meq/dry resin, more preferably from 1.0 to 3.0 meq/dry resin.

Thus, according to the method of the present invention, in a method for treating a plating solution for an iron plating, iron-zinc alloy plating or other iron alloy plating, it is possible to convert $Fe^{3+}$ ions in the plating solution to $Fe^{2+}$ ions inexpensively and certainly for a long period of time without the necessity of supplementing such ions.

Now, the present invention will be described in further detail with reference to Examples. However, it should be understood that the present invention is by no means restricted by such specific Examples.

EXAMPLE 1

An electrolytic cell was prepared in which a cathode compartment and an anode compartment was divided by a cation exchange membrane (a strongly acidic membrane made essentially of a styrene-divinyl benzene copolymer resin and having an ion exchange capacity of 1.8 meq/g), an electrode comprising a powder mixture of platinum and iridium sintered on a titanium plate and having a specific surface area of 100 $m^2/g$ and a hydrogen overvoltage of 80 mV, was used as the cathode, and an electrode of titanium-platinum alloy was used as the anode (the distance between the electrodes being 4 mm).

From a plating bath, a sulfuric acid solution (pH $=1.2$) containing 5 g/liter of $Fe^{3+}$ and 60 g/liter of $Fe^{2+}$ was supplied to the cathode compartment of the electrolytic cell at a rate of 5 liter/hr. and recycled between the cell and the bath, while 5% sulfuric acid was supplied to the anode compartment at a rate of 5 liter/hr. and recycled. Electrolysis was conducted at a current density of 10 $A/dm^2$ continuously for 4 hours.

As a result, the concentration of $Fe^{3+}$ was reduced to 4 g/liter, and no precipitation of iron on the cathode plate was observed.

EXAMPLE 2

Electrolysis was conducted in the same manner as in Example 1 except that instead of the cathode used in Example 1, an electrode having an iron-nickel alloy surface subjected to etching treatment with an acid and having a specific surface area of 200 $m^2/g$ and a hydrogen overvoltage of 120 mV was used, whereby the concentration of $Fe^{3+}$ was reduced from 5 g/liter to 1 g/liter. No precipitation of iron on the cathode was observed, but the cell voltage increased gradually by 350 mV during one month operation.

EXAMPLE 3

An electrolytic cell was prepared wherein a cathode compartment and anode compartment was partitioned by the same cation exchange membrane as used in Example 1, an electrode prepared by fixing to a stainless steel plate a carbon fiber non-woven fabric (manufactured by Mitsubishi Rayon Company Ltd.) made of carbon fibers prepared by bundling 2,000 filaments with a diameter of 3 $\mu m$ and having an apparent thickness of 0.4 mm, a weight of 30 $g/m^2$ and a density of 0.075 $g/cm^3$ by stitching with a carbon thread and having a hydrogen overvoltage of 45 mV, was used as the cathode, and an electrode having a platinum-iridium alloy coated on a titanium plate has used as the anode (the distance between the electrodes being 4 mm).

From a plating bath, a sulfuric acid solution (pH $=1.2$) containing 5 g/liter of $Fe^{3+}$ and 60 g/liter of $Fe^{2+}$ was supplied to the cathode compartment of the electrolytic cell at a rate of 5 liter/hr. and recycled between the cell and the bath, while 5% sulfuric acid was supplied to the anode at a rate of 5 liter/hr. and recycled. Electrolysis was conducted at a current density of 5 $A/dm^2$ continuously for 1 hour.

As a result, the concentration of $Fe^{3+}$ was reduced to 1 g/liter, and no precipitation of iron on the cathode plate was observed.

EXAMPLE 4

Electrolysis was conducted in the same manner as in Example 1 except that instead of the cathode used in Example 1, an electrode prepared by fixing to a stainless steel a carbon fiber woven fabric with 12 warp yarns and 10 weft yarns each prepared by bundling 2,000 filaments with a diameter of of 3 μm and having a weight of 176 g/m$^2$, a thickness of 0.24 mm and a density of 0.73 g/cm$^3$ by stitching with a carbon thread and having a hydrogen overvoltage of 85 mV, was used, whereby the concentration of $Fe^{3+}$ was reduced from 5 g/liter to 1.3 g/liter. No precipitation of iron on the cathode was observed and the cell voltage remained the same during one month operation.

EXAMPLE 5

A carbon powder having a specific surface area of 165 m$^2$/g and a particle size of 40 μm was kneaded with a fluorinated resin in an amount of 80 g per 20 g of the resin and formed into a film having a thickness of 1 mm and a hydrogen overvoltage of 135 mV. The specific surface area of this film was 100 m$^2$/g as measured by a nitrogen gas adsorption method. Electrolysis was conducted in the same manner as in Example 1 except that this film was used as a cathode instead of the cathode used in Example 1, whereby the concentration of $Fe^{3+}$ was lowered from 5 g/liter to 1.5 g/liter. No precipitation of iron on the cathode was observed.

EXAMPLE 6

Electrolysis was conducted in the same manner as in Example 1 except that instead of the cathode used in Example 1, an electrode prepared by fixing to a stainless steel plate three sheets of a carbon fiber woven fabric with 12 warp yarns and 10 weft yarns each prepared by bundling 2,000 filaments with a diameter of 3 μm and having a weight of 176 g/m$^2$, a thickness of 0.24 mm and a density of 0.73 g/cm$^3$ by stitching with a polypropylene thread and having a hydrogen overvoltage of 30 mV, was used, whereby the concentration of $Fe^{3+}$ was lowered from 5 g/liter to 1.0 g/liter. No precipitation of iron on the cathode was observed.

COMPARATIVE EXAMPLE

Electrolysis was conducted in the same manner as in Example 1 except that instead of the cathode used in Example 1, a smooth surface plate of SUS 316 (hydrogen overvoltage: 500 mV) was used as a cathode, whereby the concentration of $Fe^{3+}$ was lowered from 5 g/liter to 4 g/liter, and iron precipitated on the cathode plate. Thus, there was a danger of damaging the ion exchange membrane.

We claim:

1. A method for treating a plating solution in an electrolytic cell having a cathode compartment and an anode compartment partitioned by an ion-exchange membrane, which comprises supplying a plating solution containing not more than 10 g/liter of $Fe^{3+}$ ions to the cathode compartment and an electrically conductive solution to the anode compartment, and electrolytically reducing the $Fe^{3+}$ ions in the plating solution to $Fe^{2+}$ ions, wherein an electrode having a hydrogen overvoltage of not higher than 350 mV is used as a cathode.

2. The method according to claim 1, wherein the cathode has, as the electrode surface area, a specific surface area of at least 0.1 m$^2$/g as measured by a nitrogen gas adsorption method.

3. The method according to claim 1, wherein the cathode is made of a woven fabric or non-woven fabric of carbon, or a carbon powder.

4. The method according to claim 1, wherein the cathode is made of a Raney nickel, a platinum-group metal powder coated on a valve metal, or an iron alloy treated by etching.

5. The method according to claim 1, wherein the ion exchange membrane is a cation exchange membrane having an ion exchange capacity of from 0.2 to 4.0 meq/g dry resin.

6. The method according to claim 5, wherein the anions in the plating solution are sulfuric acid ions or halogen ions, and the pH of the plating solution is from 0.5 to 3.

7. The method according to claim 6, wherein the electrically conductive solution is an aqueous acid solution of the same anions as contained in the plating solution.

* * * * *